US011117167B2

(12) United States Patent
Galk et al.

(10) Patent No.: US 11,117,167 B2
(45) Date of Patent: Sep. 14, 2021

(54) SEPARATOR

(71) Applicant: NEUMAN & ESSER PROCESS TECHNOLOGY GMBH, Übach-Palenberg (DE)

(72) Inventors: Joachim Galk, Gangelt-Birgden (DE); Thomas Mingers, Übach-Palenberg (DE); Marc Giersemehl, Krefeld (DE)

(73) Assignee: NEUMAN & ESSER PROCESS TECHNOLOGY GMBH, Übach-Palenberg (DE)

( * ) Notice: Subject to any disclaimer, the term of this patent is extended or adjusted under 35 U.S.C. 154(b) by 182 days.

(21) Appl. No.: 16/092,586

(22) PCT Filed: Apr. 7, 2017

(86) PCT No.: PCT/EP2017/058430

§ 371 (c)(1),
(2) Date: Oct. 10, 2018

(87) PCT Pub. No.: WO2017/178379

PCT Pub. Date: Oct. 19, 2017

(65) Prior Publication Data

US 2019/0168263 A1 Jun. 6, 2019

(30) Foreign Application Priority Data

Apr. 11, 2016 (DE) ..... 10 2016 106 588.9

(51) Int. Cl.

| | |
|---|---|
| ***B07B 11/06*** | (2006.01) |
| ***B07B 4/02*** | (2006.01) |
| ***B07B 7/083*** | (2006.01) |

(52) U.S. Cl.
CPC ..... *B07B 4/025* (2013.01); *B07B 7/083* (2013.01); *B07B 11/06* (2013.01)

(58) Field of Classification Search
CPC ..... B07B 4/025; B07B 7/083; B07B 11/06
See application file for complete search history.

(56) References Cited

U.S. PATENT DOCUMENTS 3,015,392 A * 1/1962 Rozsa ..... B07B 7/083 209/134
4,551,241 A * 11/1985 Saverse ..... B07B 4/025 209/135
4,799,595 A * 1/1989 Binder ..... B07B 7/083 209/135

(Continued)

FOREIGN PATENT DOCUMENTS

CH 363879 A * 8/1962 ..... B07B 7/083
CH 363879 A 9/1962

(Continued)

OTHER PUBLICATIONS

Chinese Office Action dated Nov. 26, 2020 for family member Application No. 201780022436.2.

*Primary Examiner* — Patrick H Mackey
(74) *Attorney, Agent, or Firm* — Hudak, Shunk & Farine Co. LPA

(57) ABSTRACT

A separator having a housing, a feed cone and a rotatable dispersing plate, on the upper face of which dispersing blades which are distributed across the periphery of the dispersing plate are arranged. The feed cone is arranged on the housing at a distance from the dispersing plate. The precision of the separator is improved compared to conventional separators.

29 Claims, 16 Drawing Sheets

(56) References Cited

U.S. PATENT DOCUMENTS

| | | | | | |
|---|---|---|---|---|---|
| 4,869,786 | A * | 9/1989 | Hanke | B07B 7/083 209/139.2 | |
| 5,016,823 | A * | 5/1991 | Kato | B07B 7/0865 209/143 | |
| 5,458,245 | A * | 10/1995 | Heckel | B07B 4/025 209/139.1 | |
| 5,533,629 | A * | 7/1996 | Ito | B07B 7/083 209/714 | |
| 6,269,955 | B1 * | 8/2001 | Morimoto | B07B 7/08 209/139.1 | |
| 6,276,534 | B1 | 8/2001 | Huang et al. | | |
| 6,827,221 | B1 * | 12/2004 | Brundiek | B02C 23/16 209/208 | |
| 8,813,967 | B2 * | 8/2014 | Plant | B07B 7/02 209/139.1 | |
| 9,981,290 | B2 * | 5/2018 | Goosen | B07B 7/086 | |
| 10,137,478 | B2 * | 11/2018 | Hagemeier | B07B 7/083 | |

FOREIGN PATENT DOCUMENTS

| | | | | |
|---|---|---|---|---|
| CN | 204656949 | U | 9/2015 | |
| CN | 104984910 | A | 10/2015 | |
| DE | 3808022 | A1 | 9/1989 | |
| DE | 3808022 | A1 * | 9/1989 | B07B 11/04 |
| DE | 3823380 | C2 | 1/1990 | |
| DE | 4302857 | A1 | 8/1994 | |
| DE | 19961837 | A1 | 6/2001 | |
| DE | 202012102964 | U1 | 11/2012 | |
| DE | 102013101517 | A1 | 8/2014 | |
| EP | 0442788 | A1 | 8/1991 | |
| EP | 0645196 | A1 | 3/1995 | |
| EP | 1184090 | A1 | 3/2002 | |
| EP | 1529568 | A2 | 5/2005 | |
| EP | 2204240 | A1 | 7/2010 | |
| EP | 2659988 | A1 | 11/2013 | |
| FR | 2597766 | A1 | 10/1987 | |
| WO | 2014124899 | A1 | 8/2014 | |

* cited by examiner

SEPARATOR

FIELD OF THE INVENTION

The invention relates to a separator comprising a housing, a feed cone, a rotatable dispersing plate, on the upper face of which dispersing blades which are distributed across the periphery of the dispersing plate are arranged.

BACKGROUND OF THE INVENTION

DE 38 23 380 C2 discloses such a separator with a spreading plate, on which the material being processed is placed centrally. Over the circumference of the spreading plate there are secured impact elements rigidly or freely suspended beneath the outer rim. The spreading plate is driven independently of the rod basket. On the spreading plate, at its center, is arranged a feed cone, whose purpose is to deflect the feeding material dropping down onto the spreading plate. Owing to the centrifugal forces, the feeding material slides against the rim of the spreading plate, while at the same time the feeding material is imparted a motion component in the rotary direction of the spreading plate. At the rim of the spreading plate, the feeding material strikes against the impact elements arranged on the spreading plate, so that the aggregates of material are broken up at this place.

After dropping down from the spreading plate, the particles of the feeding material strike against further outwardly projecting impact elements of the spreading plate.

Impact elements may also be fastened to the circumference of the rod basket. By means of guide plates arranged on the inside of the separator housing above the sifting zone between rod basket and guide vane ring, the material is supposed to be concentrated and guided into the impact range of the impact elements of the rod basket.

Despite various provisions, the deagglomeration is not satisfactory.

DE 43 02 857 A1 discloses a cleaning device for cleaning a grain batch, comprising a spreading divider on which are fastened both a hood and a truncated cone, which in turn carries a cone. No impact elements are provided.

WO 2014/124899 A1 describes a separator having installed parts in the sifting zone between the air guidance system and the rotor basket, which are supposed to have the effect of at least partly deagglomerating the agglomerated particles of feeding material. This is supposed to allow a more efficient sifting process. The installed parts are arranged such that they extend in parallel with the rotation axis of the rotor basket or make an angle with the rotor axis. The installed parts, which may be formed by end regions of the guide vanes of the air guidance system, form bottlenecks or constrictions in the circumferential direction of the sifting zone.

DE 199 61 837 A1 likewise shows installed parts in the form of guide flaps protruding into the sifting zone, extending in parallel with the axis of the dynamic rotor part.

EP 1 529 568 B1 discloses a cyclone separator, in which the flow cross section in the flow direction of the product is constricted in at least one place upstream from the separation zone. Diaphragms such as cone rings are used for this, which may be installed in several places in the sifting zone.

SUMMARY OF THE INVENTION

The problem which the invention proposes to solve is to provide a separator whose separating efficiency is higher than that of the separators in the prior art.

By separating efficiency is meant the ratio $\kappa = x_{25}/x_{75}$, where $x_{25}$ and $x_{75}$ denote the particle sizes of the particles whose fraction amounts to 25% and 75%, respectively.

This problem is solved with a separator comprising a housing, a feed cone, a rotatable dispersing plate, on the upper face of which dispersing blades which are distributed across the periphery of the dispersing plate are arranged wherein the feed cone is arranged on the housing at a distance from the dispersing plate, and a separator comprising a separator wheel having separator wheel paddles and an air guidance system having guide vanes for the supply of separating air, while an annular separating space is arranged between the separator wheel and the air guidance system, wherein the guide vanes are guide plates protruding into the separating space and extending in the vertical direction.

The separator is characterized in that the feed cone is arranged on the housing at a distance from the dispersing plate.

Because the feed cone is arranged stationary on the housing, the particles of the feeding material and especially the agglomerates of the feeding material only possess a vertical and a radial movement component.

When the agglomerates slide down from the feed cone, the agglomerates are caught by the dispersing blades of the dispersing plate rotating beneath the feed cone and broken up. The dispersing blades are arranged on the upper face of the dispersing plate, distributed around the circumference of the dispersing plate.

Preferably, four to twenty dispersing blades are provided. The lower the angular velocity $\omega$ of the dispersing plate, the larger the number of dispersing blades should be selected.

The impact effect of the dispersing blades is appreciably greater than in the prior art, because the agglomerates upon striking against the dispersing blades still have no movement component in the rotary direction of the dispersing plate. The separating efficiency of the separator is appreciably improved, because not only is a larger quantity of agglomerates deagglomerated, but also the agglomerates are also broken up almost entirely into their original single particles.

Preferably the feed cone has an aperture angle ß of $45° \leq ß \leq 90°$. This is a pointed cone, which has the advantage that the slope of the conical surface is large and the particles of the feeding material are therefore only slightly braked in their vertical movement before they strike against the dispersing blades.

Preferably the feed cone at its cone edge has a radius R1 for which: $0.5 \times R_2 < R_1 < R_2$, where $R_2$ denotes the radius of the dispersing plate. When this condition is met, it is ensured that the cone edge of the feed cone extends as far as possible up to the edge of the dispersing plate and thus the particles of the feeding material strike against a region of the dispersing plate and the dispersing blades having a correspondingly large orbital velocity v.

The momentum $p = m \times v$ acting on the agglomerates is greater as the orbital velocity v is higher. It is therefore advantageous to select the radius $R_2$ of the dispersing plate as large as possible, because then the radius R1 of the cone edge may also be chosen large within the range of $0.5 \times R_2$ to $R_2$. The orbital velocity v at the radially exterior end of the dispersing blade preferably lies in the range of 40 m/s to 150 m/s, especially in the range of 80 m/s to 150 m/s.

On the other hand, $R_1$ should not be chosen too large, so that the agglomerates dropping down from the feed cone do not shoot out beyond the edge of the dispersing plate on account of their radial velocity. It is therefore preferable to select $R_1 < 0.9 \times R_2$, especially $R_1 < 0.8 \times R_2$.

Preferably the radius $R_3$ of the inner circumference of the dispersing blades is $R_3 \leq R_1$. The inner circumference of the dispersing blades denotes the circle on which the inner surfaces of the dispersing blades lie that are pointing radially toward the midpoint of the dispersing plate.

In this way, it is ensured that the feed cone also extends by its cone edge into the region of the dispersing blades, so that the particles and thus also the agglomerates upon dropping down from the feed cone are first caught up by the dispersing blades before striking against the upper face of the dispersing plate.

Preferably the distance A1 between the cone edge of the feed cone and the dispersing blades is $0<A_1 \leq 30$ mm and in particular is 5 mm to 30 mm, especially 5 mm to 25 mm. The benefit of a slight distance A1 is that the agglomerates of the feeding material are caught up by the dispersing blades and broken apart immediately after leaving the feed cone.

Preferably each dispersing vane has a dispersing surface which is situated perpendicular to the rotation direction of the dispersing plate. This has the advantage that a maximum force action on the incoming agglomerates of the feeding material is assured.

Preferably the dispersing vanes are plates sticking up from the upper face of the dispersing plate and extending in the radial direction.

Preferably there is provided on the housing an impact ring, having impact elements distributed over the circumference and projecting in the direction of the dispersing plate.

The impact ring is preferably arranged stationary on the housing. Preferably 24 or more than 24 impact elements are provided.

The particles of the feeding material hurled outward from the impact ring by virtue of the centrifugal forces not only strike against the impact ring, but also thanks to their movement component in the rotary direction of the rotary plate against the impact elements. The advantage of the impact ring with the impact elements is that agglomerates which might not have been fully broken down into single particles by the dispersing blades of the dispersing plate can be effectively fragmented in this second stage of dispersing. This further improves the deagglomeration.

The distance $A_2$ between the impact elements and the dispersing plate is preferably $0<A_2 \leq 30$ mm, especially 10 mm$\leq A_2 \leq$30 mm.

The impact elements are configured and arranged such that they lie opposite at least the dispersing blades. This means that the vertical extension of the impact elements is chosen so large that it corresponds at least to the height of the dispersing blades. This ensures that as many particles of the feeding material as possible which leave the dispersing plate are caught up by the impact elements.

Preferably, the separator comprises a separator wheel having separator wheel paddles and an air guidance system having guide vanes for the supply of separating air, while an annular separating space is arranged between the separator wheel and the air guidance system.

Such separators are also known as deflector wheel separators.

Preferably, the guide vanes are guide plates protruding into the separating space and extending in the vertical direction.

The problem is also solved with a separator having a separator wheel having separator wheel paddles and an air guidance system having guide vanes for the supply of separating air, while an annular separating space is arranged between the separator wheel and the air guidance system, wherein the guide vanes are guide plates protruding into the separating space and extending in the vertical direction.

This separator does not comprise the dispersing plate and feed cone according to the invention, but only the air guidance system according to the invention.

Preferably, the dispersing plate is fastened to the separator wheel. The advantage is that the dispersing plate does not require its own drive system and it is driven by the separator wheel. Thus, the dispersing plate has the same angular velocity as the separator wheel.

Thanks to the rotating separator wheel, a circular flow is created in the separating space, wherein the feeding material is carried radially to the outside by virtue of the centrifugal force. At the same time, the air brought in through the air guidance system imparts to the particles of the feeding material a movement component in the direction of the separator wheel.

It has been found that the feeding material, especially also the deagglomerated feeding material before and in the separating space, has a tendency to form strands, which impair the classification.

By strands is meant an accumulation of particles in a gas stream which is formed as a result of demixing, e.g., by the action of gravity and centrifugal force. Strands have their origin in an exceeding of the gas carrying capacity for the solid particles. Thus, the strands also contain smaller particles, which would otherwise get into the fines with the air flow when the solids burden is less.

Thanks to the guide plates protruding into the separating space, a specific breaking up of the strands occurs, so that an improved separation is possible especially for the very finest particles, without affecting the result of the separation process.

Thanks to the guide plates protruding into the separating space, not only are the strands broken up, but also an additional movement component is imparted to the particles of the feeding material in the direction of the separator wheel.

Thanks to these provisions, the separating efficiency of the separator is improved.

Preferably the air guidance system has air windows and a guide plate is arranged on at least one edge of the air windows.

The air guidance system preferably has an annular wall, in which the air windows are situated. The air flowing in through the air windows is deflected by the guide plates, thereby influencing the flow into the separating space.

The guide plates thus perform two tasks. Both the particles of the feeding material and the incoming separating air are influenced in the desired manner. Thanks to the angle of attack $\gamma$ of the guide plates, both flows can be specifically adjusted. The angle of attack $\gamma$ is subtended between the guide plates in the flow direction of the particle/air mixture in the separating space and the inner radius RL of the air guidance system. Preferably the angles $\gamma$ are the same for all guide plates.

Preferably, the guide plates are arranged on opposite edges of the air windows. Thus, each air window has two guide plates, by which the inflowing air stream can be introduced in an even more targeted manner.

Preferably, the guide plates are arranged between two respective air windows such that their ends converge on each other. The guide plates in this embodiment preferably have different angles of attack $\gamma$.

The ends of the guide plates are preferably spaced apart, i.e., the ends of the guide plates preferably do not touch.

Preferably, the two respective guide plates which are arranged at each air window are oriented parallel to each other. These guide plate pairs form an air duct, which preferably has a constant width.

Preferably, the guide plates have an angle of attack $\gamma$ which lies in the range of 30° to 60°, especially preferably in the range of 40° to 50°.

The guide plates are preferably flat rectangular guide elements.

According to another particular embodiment, the guide plates are curved in the direction of the separator wheel. The angle of attack $\gamma$ of the curved guide plate is subtended between the tangent T at the middle of the outer surface of the guide plate and the inner radius $R_L$ of the air guidance system in the flow direction of the particle/air stream. The flow direction of the particle/air stream is defined by the rotary direction of the separator wheel. The curved embodiment of the guide plates has the advantage that the particle/air stream is deflected even more effectively onto the separator wheel.

Preferably, the guide plates have a single radius of curvature $R_4$.

According to another embodiment it is provided that the guide plates are curved such that the radius of curvature $R_4$ decreases in the direction of the separator wheel.

The radius of curvature is preferably 5 mm$\leq R_4 \leq$2000 mm.

Preferably, the air guidance system has at least one cone ring with a particle guide element protruding into the separating space and having a first conical surface.

The particle/air stream has not only a horizontal movement component, but also a vertical movement component on account of gravitation. The flow cross section of the separating space in the vertical movement direction is constricted by the cone ring, whereby the particle/air stream is deflected by the conical surface of the particle guide element in the direction of the separator wheel. This provision also contributes to an improved separating efficiency of the separator.

Preferably, the conical surface is arranged on the upper face of the particle guide element and forms an angle $\alpha$ with a vertical axis LV of $10° < \alpha < 90°$, especially preferably $20° < \alpha < 80°$.

Preferably, the distance A4 between the inner circumference of the air guidance system and the outer circumference of the separator wheel is $A_4 = ½ \cdot DS(V-1)$, where $V = D_L/D_S$ with $1.01 \leq V \leq 1.2$, $D_S$ denotes the outer diameter of the separator wheel and DL the inner diameter of the air guidance system. It has been shown that the classification and separation of the residual fine dust fraction can be further improved by maintaining certain limit values for this distance A4, which describes the width of the separating space, as defined by the relation $V = D_L/D_S$. Preferably the ratio V of the diameters $D_L/D_S$ is $1.05 \leq V \leq 1.1$.

Preferably, the distance $A_3$ from the inner edge of the particle guide elements and/or the ends of the guide plates to the inner circumference of the separator wheel is $0.005 \times A_4 \leq A_3 \leq 0.5 \times A_4$.

Preferably, the air guidance system has at least one circumferential horizontal air slot. This horizontal air slot may extend partly or over the entire circumference of the air guidance system. This produces higher radial velocities of the separator air of up to 30 m/s, by which the feeding material is taken to the separator wheel.

BRIEF DESCRIPTION OF DRAWINGS

Sample embodiments of the invention are explained more closely below with the aid of schematic drawings. These show.

DETAILED DESCRIPTION OF THE INVENTION

Figure 1:
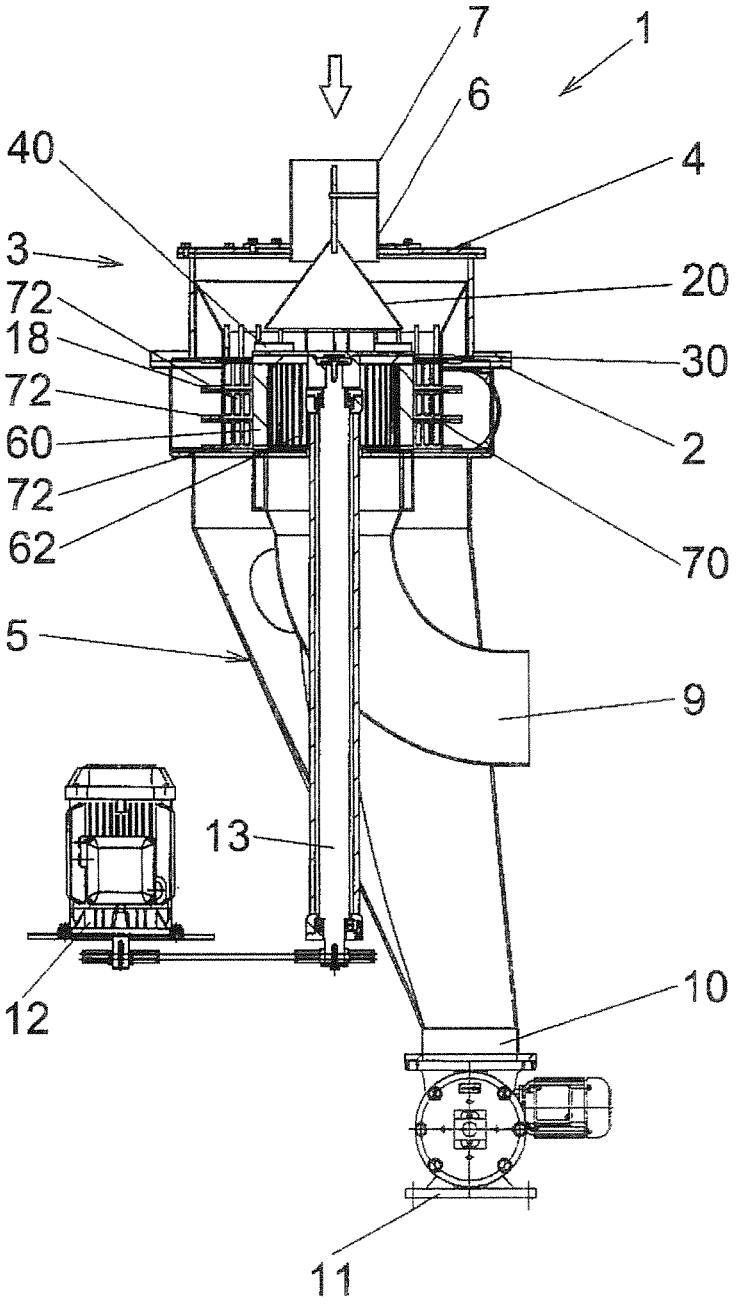
FIG. 1, a separator in vertical cross section.

FIG. 1 shows a separator 1 in vertical cross section. The separator 1 comprises a housing 2, having a fill pipe 6 and divided into an upper housing portion 3 and a lower housing portion 5. In the upper housing portion 3, which is substantially cylindrically shaped, there is situated a separator wheel 60 with separator wheel paddles 62 as well as an air guidance system 70 with three guide vane rings 72. Between the separator wheel 60 and the air guidance system 70 there is located the separating space 18. On the separator wheel 60 there is fastened a dispersing plate 30, which is thereby driven by the separator wheel 60.

The dispersing plate 30 has dispersing blades 40 on its upper face 31 (see also FIG. 2) in the marginal region, consisting of substantially rectangular metal plates sticking up from the upper face 31 of the dispersing plate 30 and extending as far as the rim 33 of the dispersing plate 30. By means of the dispersing plate, a feed cone 20 is fixed stationary to the housing 2.

The upper housing portion 3 comprises a separator cover 4, in which the fill pipe 6 with the fill opening 7 for the feeding material is disposed. The feeding material is filled in through the fill pipe 6 into the separator 1 and strikes against the feed cone 20 there.

In the lower housing portion 5 there is arranged the drive shaft 13 for the separator wheel 60, which is driven at the lower end by a drive mechanism 12. The lower housing portion 5 moreover comprises an outlet pipe with the outlet opening 9 for discharging the fines. At the lower end of the conical lower housing portion 5 there is arranged a suction fan 11 and the outlet 10 for coarse material.

Figure 2:
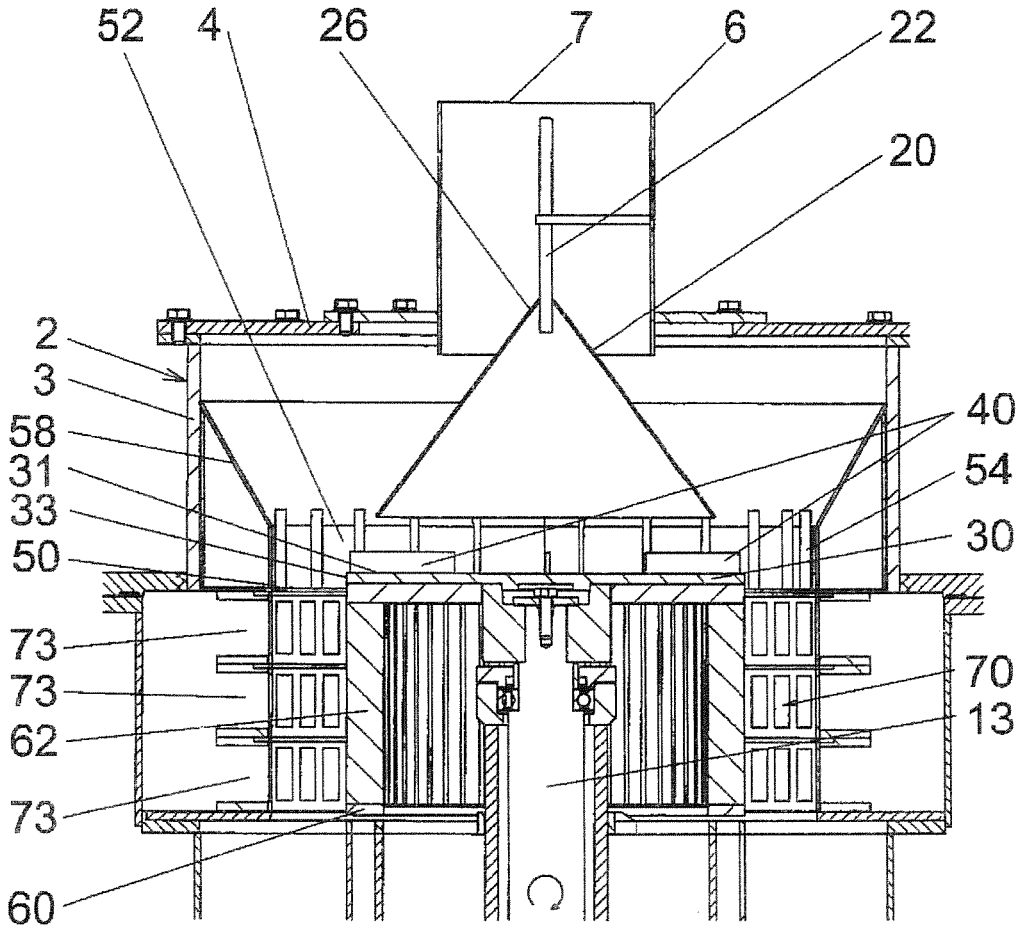
FIG. 2, a vertical cross section through the upper region of the separator shown in perspective view, FIG. 3, a top view of the separator, FIG. 4, a vertical cross section through cone and dispersing plate of the separator of FIG. 1, FIG. 5, a cutout from FIG. 4 in enlarged representation, FIG. 6, a horizontal cross section through a separator wheel and an air guidance system according to one embodiment, FIG. 7, a perspective representation of an air guidance system according to another embodiment, FIG. 8*a*, a top view of the air guidance system shown in FIG. 7 with separator wheel drawn in, FIGS. 8*b, c*, a top view of an air guidance system with separator wheel according to two embodiments with curved guide plates, FIG. 9, an enlarged cutout from FIG. 8*a,*

FIG. 2 shows a detail cross section through the upper region of the housing 3.

The feed cone 20 protrudes by its cone apex 26 into the fill pipe 6 and is secured there by means of a fastening element 22 to the fill pipe 6.

The dispersing plate 30 is surrounded by an impact ring 50, having impact elements 54 on its inner surface 52, which stick out from the inner surface 52 in the direction of the dispersing plate 30. The impact elements 54 are arranged distributed over the inner surface 52 of the impact ring 50 and extend in the vertical direction at least for the entire height of the dispersing blade 40. The impact ring 50 is adjoined at the top by a conical wall 58.

The separator wheel 60 situated beneath the dispersing plate 30 has a plurality of vertically disposed separator wheel paddles 62 and is surrounded by an air guidance system 70 with a total of three guide vane rings 72.

Figure 3:
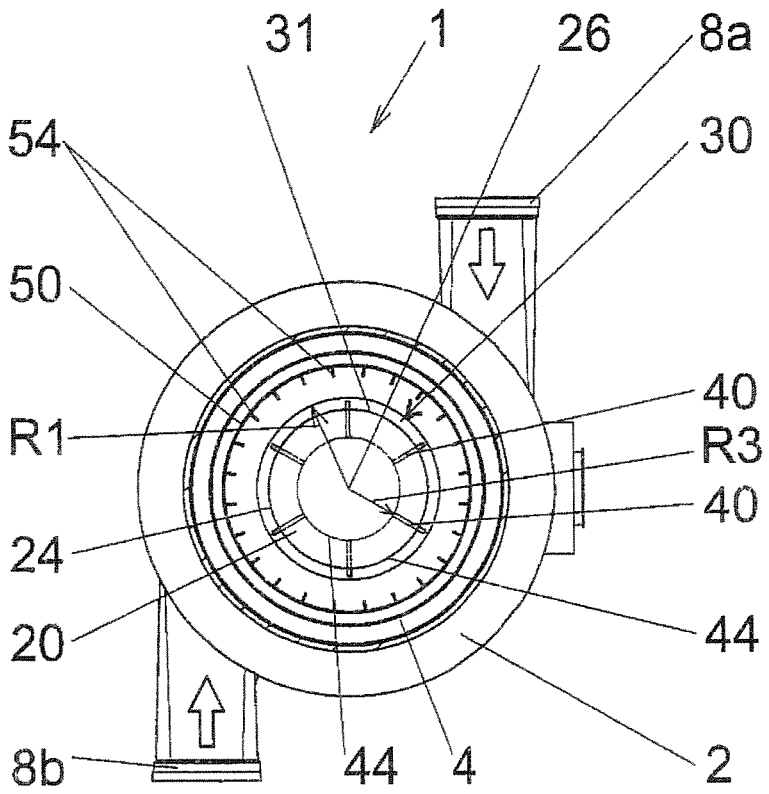

FIG. 3 shows a top view of the separator 1 shown in FIG. 1, having two separating air feeds 8*a, b* arranged tangentially on the housing portion 3. A total of twenty four impact elements 54 are arranged on the impact ring 50. The impact elements 54 are arranged at a spacing from the dispersing plate 30. The dispersing plate 30 carries on its upper face 31 six dispersing blades 40, which extend in part to beneath the feed cone 20. The inner circumference of the dispersing blades 40 is indicated by the dashed circular line 44, on which the inner surfaces 41 of the dispersing blades 40 lie. The corresponding radius $R_3$ of the inner circumference 44 of the dispersing blades 40 is likewise indicated, as is the radius R1 of the cone edge 24 of the feed cone 20.

Figure 4:
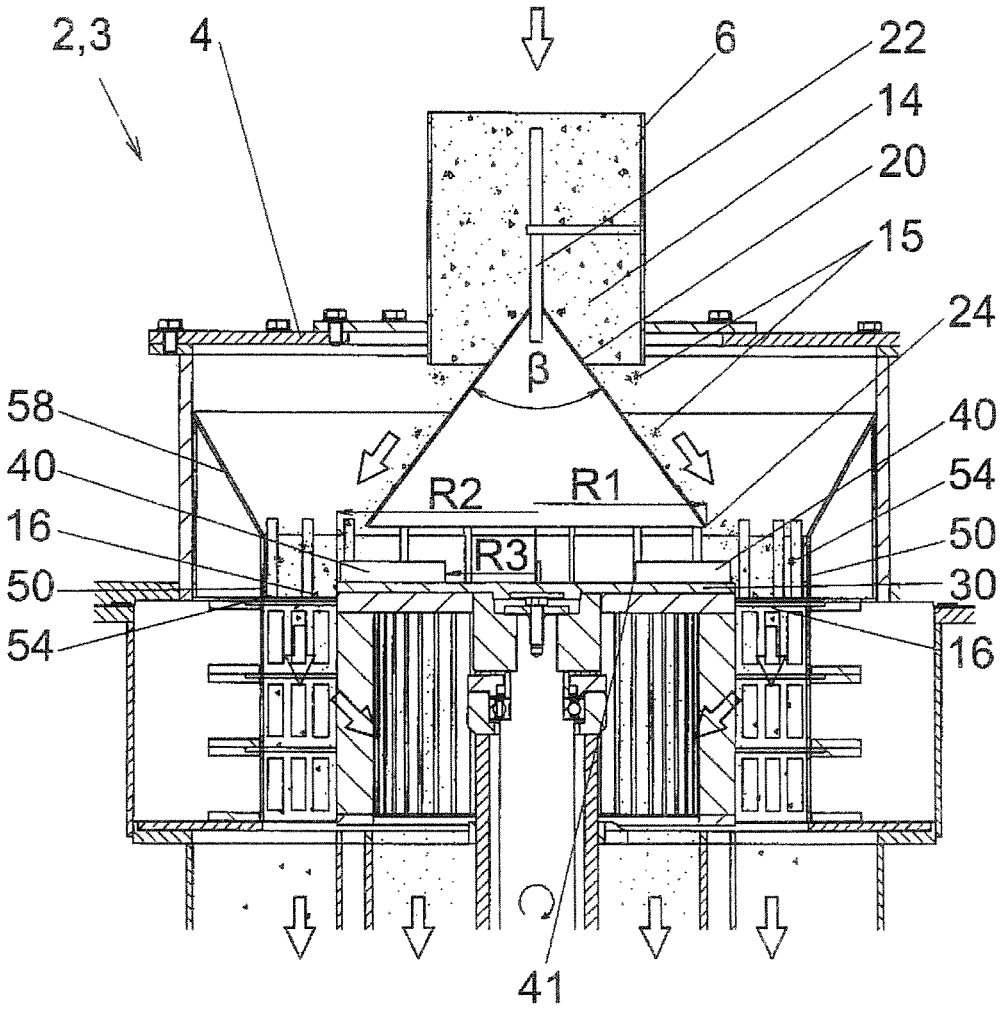
Figure 5:
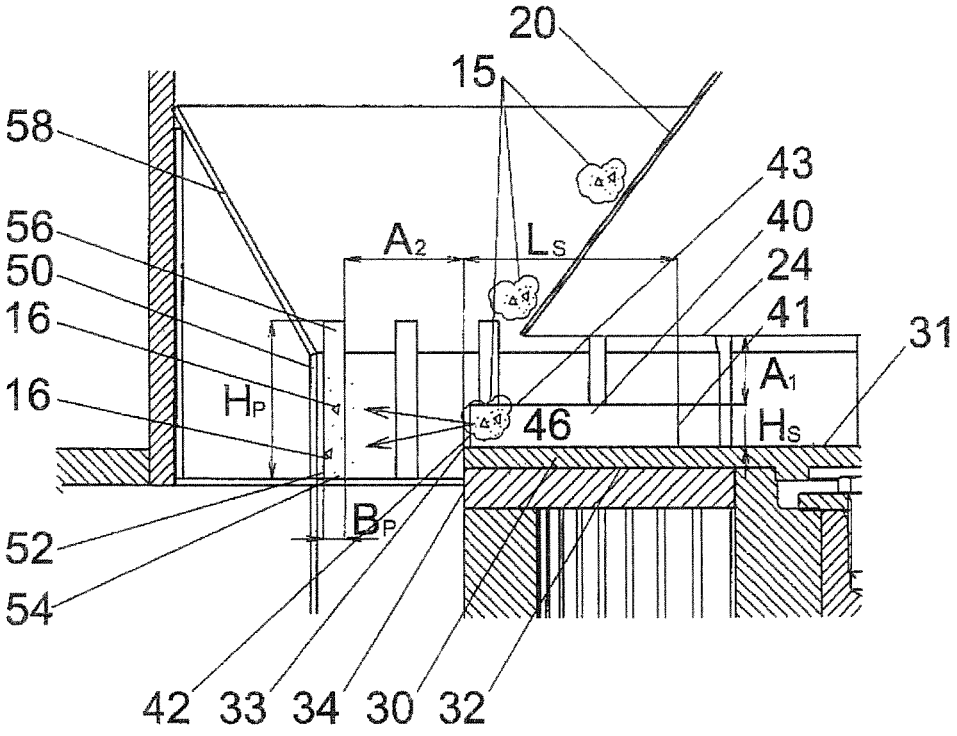

FIGS. 4 and 5 show enlarged cross sectional representations of the upper portion of the separator 1 shown in FIG. 2. The feed cone 20 has an aperture angle ß of around 85°. The feed cone 20 extends as far as the region of the dispersing blades 40, so that feeding material 14 introduced from above through the fill pipe 6 is taken directly to the dispersing blades 40. The agglomerates in the feeding material 14 are indicated by the reference number 15. The agglomerates 15 as well as the other particles of the feeding material 14 are first caught up by the dispersing surface 46 of the dispersing blades 40, before striking onto the upper face 31 of the dispersing plate 30.

Because of the centrifugal forces acting on the particles of the feeding material 14, the particles are flung in the direction of the impact ring 50, where they strike against the impact elements 54. The radii $R_1$, $R_2$ and $R_3$ are drawn in, showing that the radius $R_3$ is smaller than the radius $R_1$, and preferably for the radii $0.4\times R_2 \leq R_3 \leq 0.8\times R_2$. This ensures that the agglomerates 15 of the feeding material 14 upon leaving the feed cone 20 do not shoot out beyond the rim 33 of the dispersing plate 30 without hitting the dispersing blades 40.

This situation can be seen more clearly in a further enlarged representation of FIG. 5.

FIG. 5 shows the distance A1 between the cone edge of the feed cone 20 and the top surface 43 of the dispersing vane 40. Moreover, the distance $A_2$ between the edge surface 34 of the dispersing plate and the impact element 56 is drawn in. The outer surface 42 of the dispersing vane 40 is set back from the edge surface 34 of the dispersing plate 30.

The impact element 54 extends to beneath the plane in which the bottom side 32 of the dispersing plate 30 lies. The length $L_S$ of the dispersing blade 40 is preferably in the range of $0.02\times R_2 \leq L_S \leq 0.2\times R_2$. The height $H_S$ is preferably in the range of $0.01\times R_2 \leq H_S \leq 0.1\times R_2$.

In the embodiment shown here, $A_1 \sim R_2/6$. Preferably $A_1 < R_2/2$.

For the height $H_P$ of the impact elements 54 preferably $0.03\times R_2 \leq H_P \leq 0.5\times R_2$. The width $B_P$ of the impact element 54 is somewhat less than the height $H_S$ of the dispersing vane 40.

As a representative of the agglomerates, there is shown an agglomerate particle 15 which is sliding down along the conical surface and which is caught up by the dispersing surface 46 and broken up into single particles. The resulting deagglomerated particles 16 strike against the impact surface 56 of the impact element 54 and become further deagglomerated there.

Figure 6:
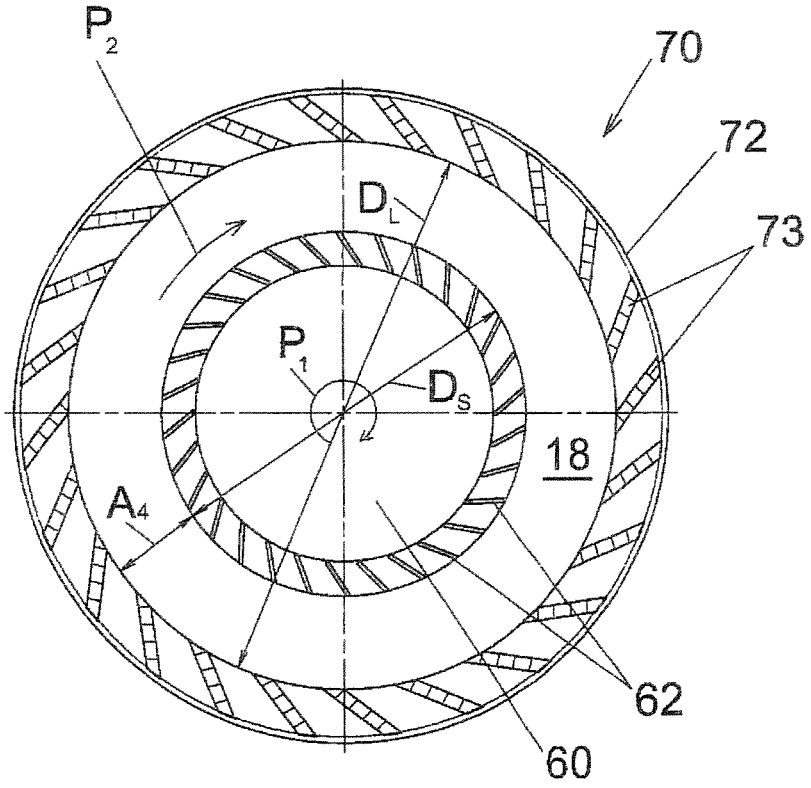

FIG. 6 shows a top view of a separator wheel 60 with separator wheel paddles 62 and a corresponding air guidance system 70 with air guide vanes 73. The guide vane ring 72 of the air guidance system 70 has an inner diameter $D_L$. The outer diameter of the separator wheel 60 is denoted as $D_S$. This results in a width $A_4$ of the annular separating space 18.

Figure 7:
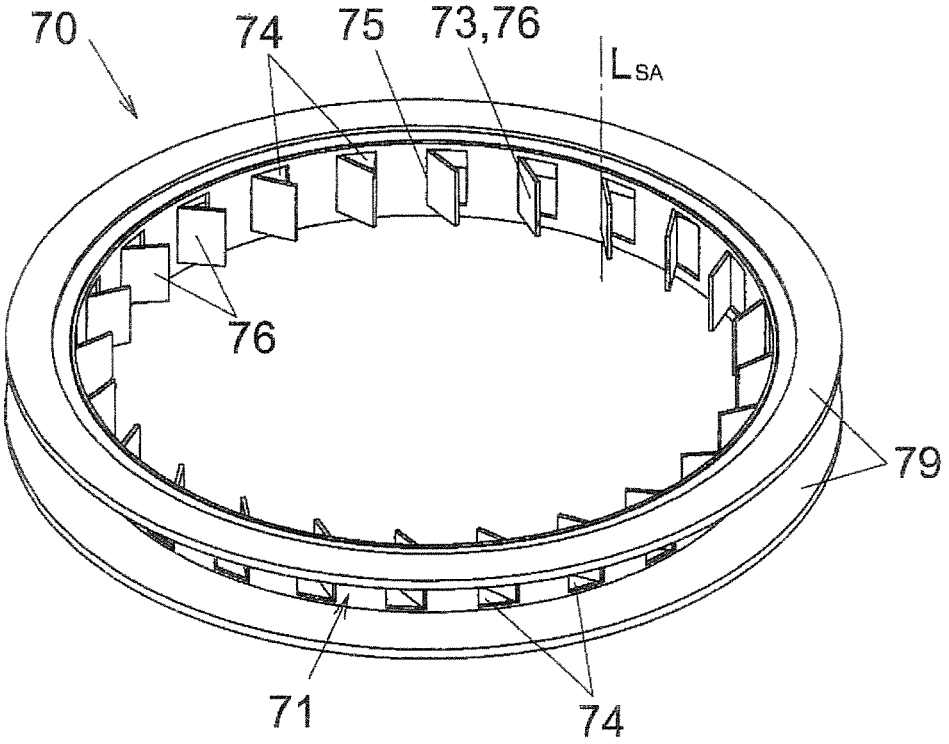

FIG. 7 shows a further embodiment of the air guidance system 70. The air guidance system 70 has two rings 79, between which an annular wall 71 with air windows 74 is arranged. The air windows 74 are arranged uniformly over the entire circumference of the annular wall 71. The embodiment shown here is a rectangular air window 74, having air guide vanes 73 in the form of guide plates 76 each time at the left edge 75. These guide plates 76 are able to swivel about an axis $L_{S4}$, so that the angle of attack γ, which is drawn in FIG. 9, can be adjusted specifically.

Figure 9:
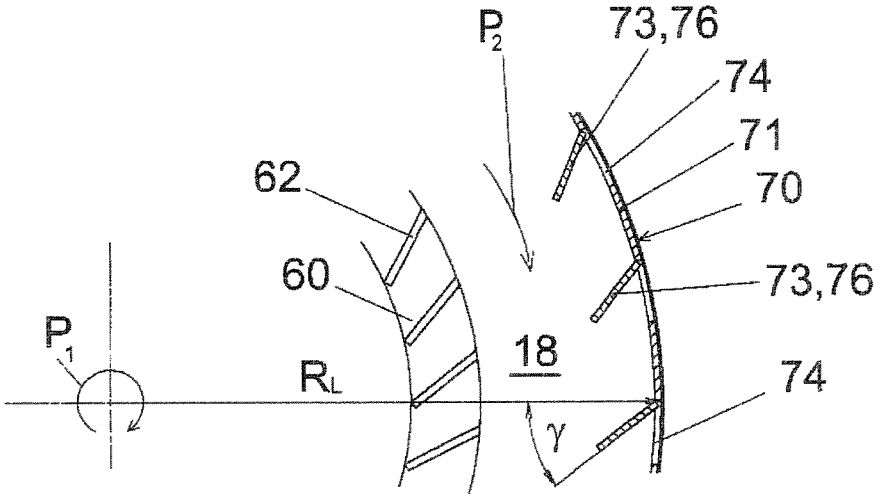

In FIG. 9, the flow direction of the particle/air stream generated by the rotation of the separator wheel 60 in the direction of the arrow $P_1$ is indicated by the arrow $P_2$ in the separating space 18. The angle γ is subtended between the inner radius $R_L$ of the air guidance system 70 and the guide plate 76.

Figure 8A:
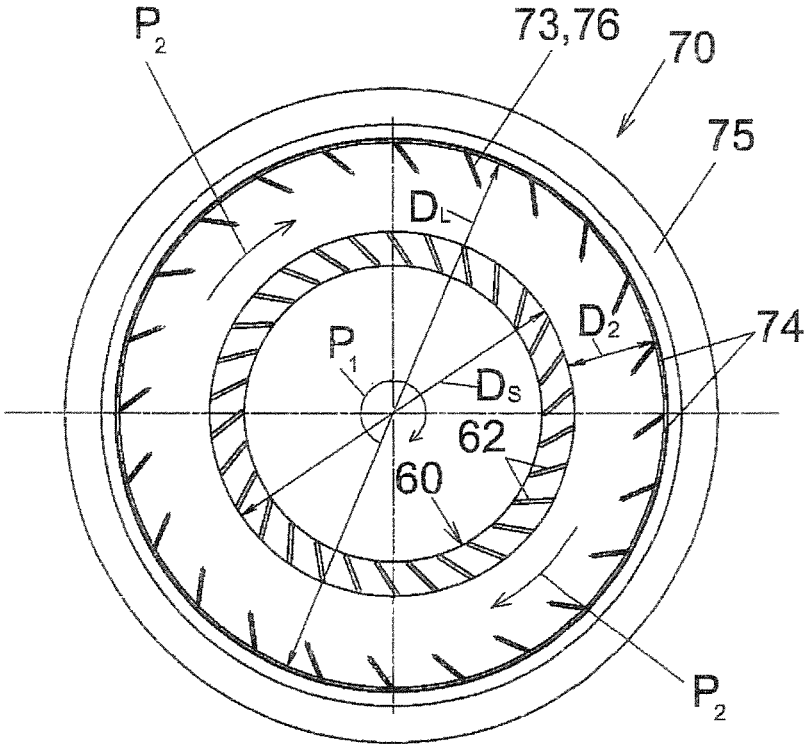

FIG. 8*a* shows the air guidance system 70 of FIG. 7 combined with a separator wheel 60. $P_1$ indicates the rotation direction of the separator wheel 60. $P_2$ denotes the flow direction of the particle/air stream.

Figure 8B:
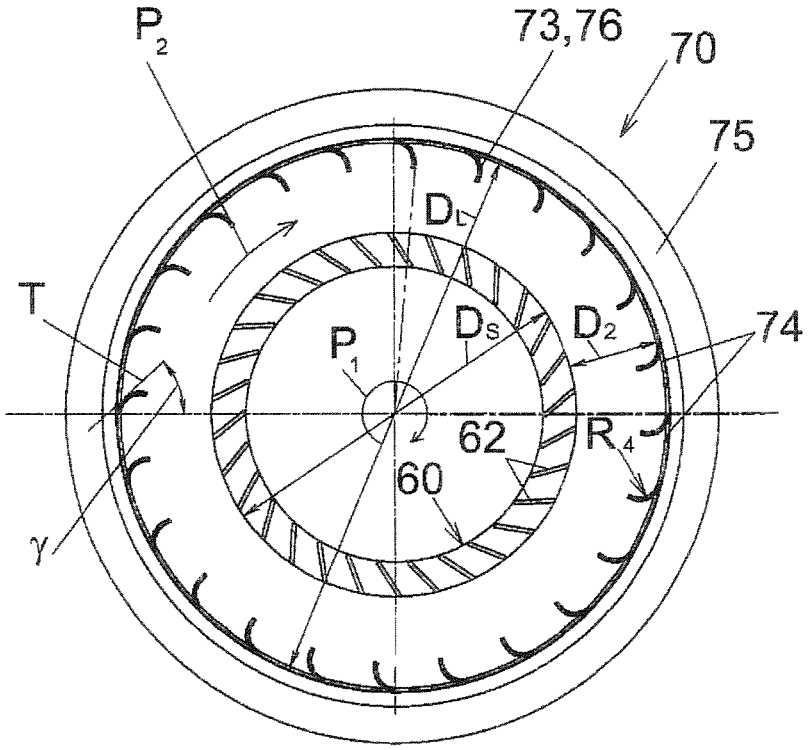

FIG. 8*b* shows a further embodiment in which the guide plates 76 are curved in design. The guide plates 76 have a uniform radius of curvature $R_4$ and are arranged curved in the direction of the separator wheel. The angle of attack γ is indicated by the tangent T through the center of the guide plate 76 and the inner radius of the air guidance system 70.

Figure 8C:
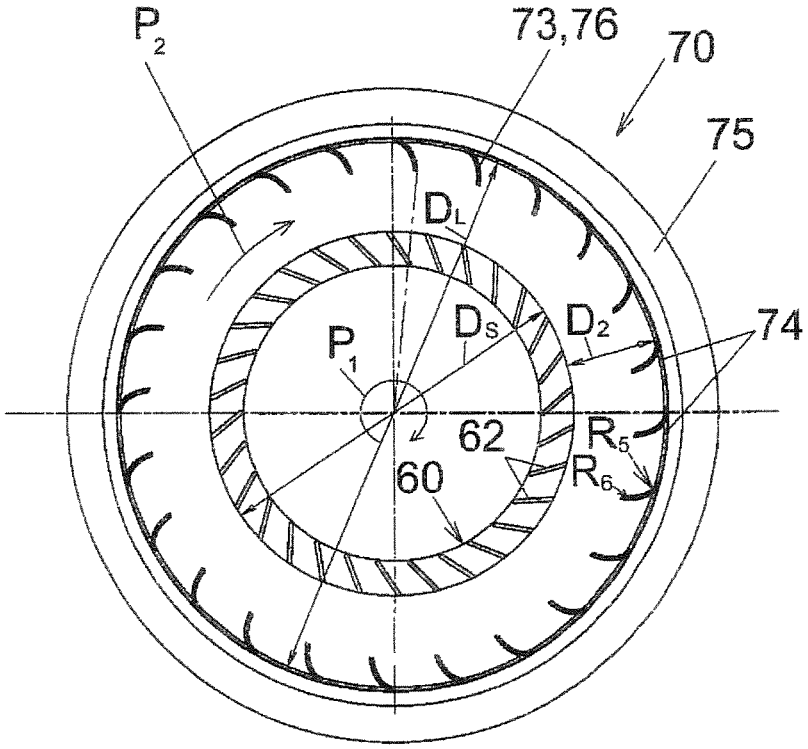

FIG. 8*c* shows a further embodiment in which the guide plates 76 do not have a uniform radius of curvature, but instead a radius of curvature which diminishes from outside to inside. The radius of curvature $R_6$ at the end of the curved guide plate 76 is smaller than the radius of curvature $R_5$.

Figure 10:
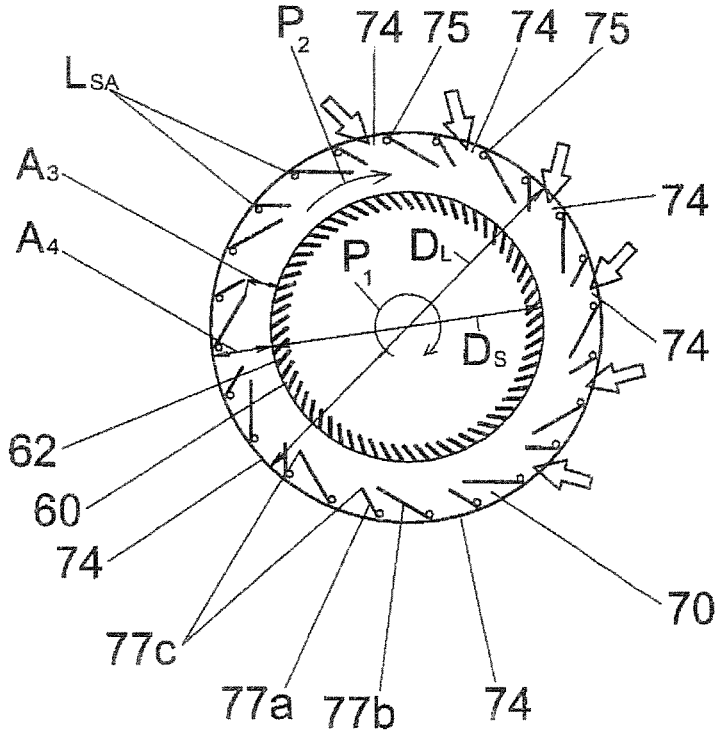
FIG. 10, another embodiment of an air guidance system with separator wheel in top view, FIG. 11, a cross section through an air guidance system according to another embodiment with a cone ring, FIG. 12, a cross section through a cone ring shown in FIG. 11, FIG. 13, an enlarged vertical cross section through the air guidance system and a corresponding separator wheel, and FIG. 14, a diagram of the cumulative distribution curves $Q_3$ to explain the yield and separating efficiency of the separator.

FIG. 10 shows a further embodiment of the air guidance system 70, in which oppositely situated guide plates 77*a*, 77*b* are arranged respectively at both edges 75 of the air window 74. The incoming air stream is designed by the arrows drawn. While the guide plates 77*a* are short in configuration, the guide plates 77*b* are longer. In the embodiment shown here, the neighboring guide plates 77*a* and 77*b* of two windows 74 are respectively oriented parallel, so that an air duct of constant width is created. The ends 77*c* of the guide plates 77*a*, 77*b* do not touch and are spaced apart from each other.

Figure 11:
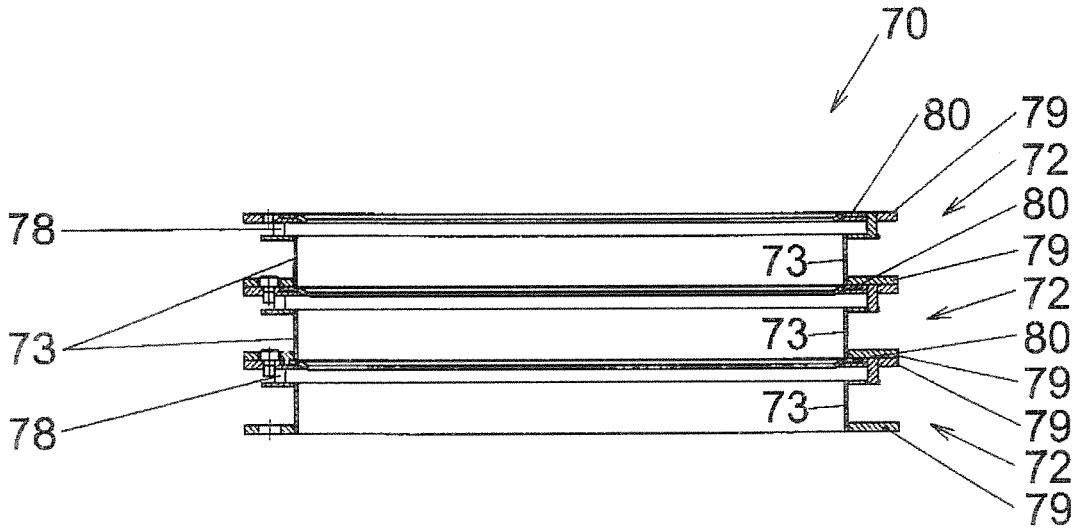

FIG. 11 shows a further embodiment of the air guidance system 70, in which three guide vane rings 72 are arranged one above another, while between the rings 79 of neighboring guide vane rings 72 there is arranged a cone ring 80 each time. Furthermore, a horizontal annular air slot 78 is provided in this air guidance system 70, through which separating air is conveyed into the separating space 18.

Figure 12:
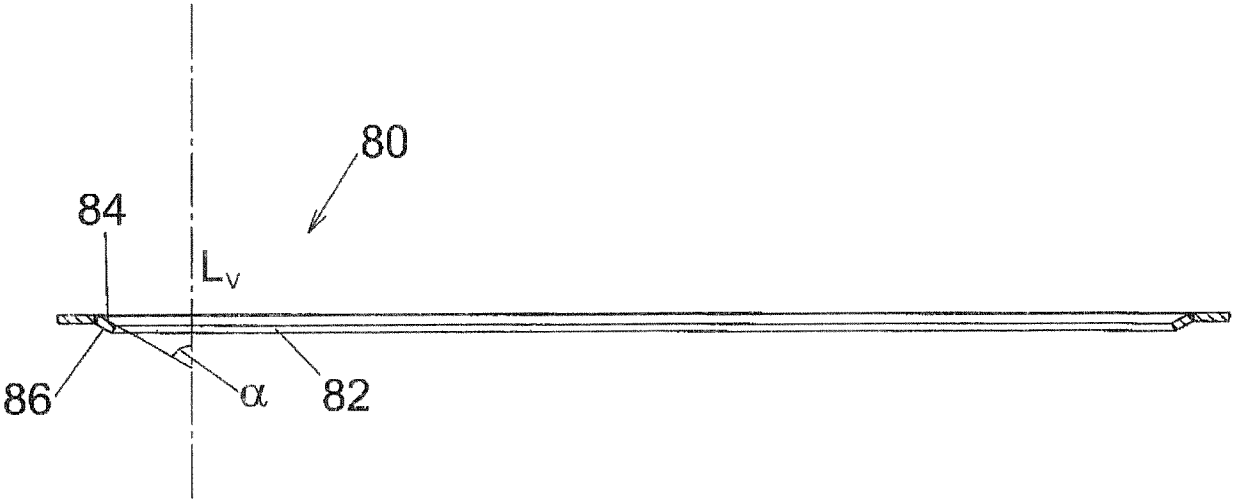

FIG. 12 shows a cone ring 80 in cross section. The cone ring 80 has a particle guide element 82 with a first conical surface 84 on the upper face and a second conical surface 86 on the bottom side. The angle of inclination of the surface 84 to a vertical axis $L_V$ is designated by $\alpha$.

Figure 13:
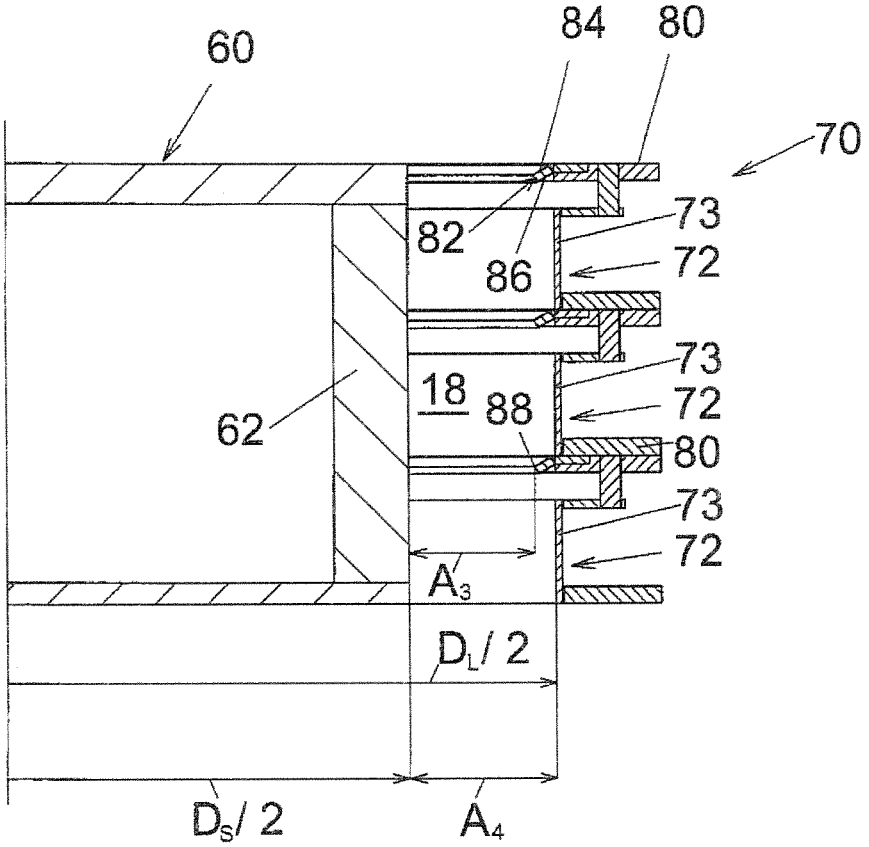

FIG. 13 shows the air guidance system 70 together with a separator wheel 60, so that it can be seen that the particle guide elements 82 protrude into the separating space 18. The distance $A_3$ from the inner edge 88 of the particle guide elements 84 to the separator wheel is designated as $A_3$. Furthermore, the diameters $D_L$ and $D_S$ as well as the distance $A_4$ between the air guidance system 70 and the separator wheel 60.

Experiments have been carried out with a mineral powder as the feeding material. The particle sizes of the feeding material were <50 μm, 70% of the particles having a size<10 μm (d70=10 μm). 20% of the particles had particle sizes<3 μm.

Figure 14:
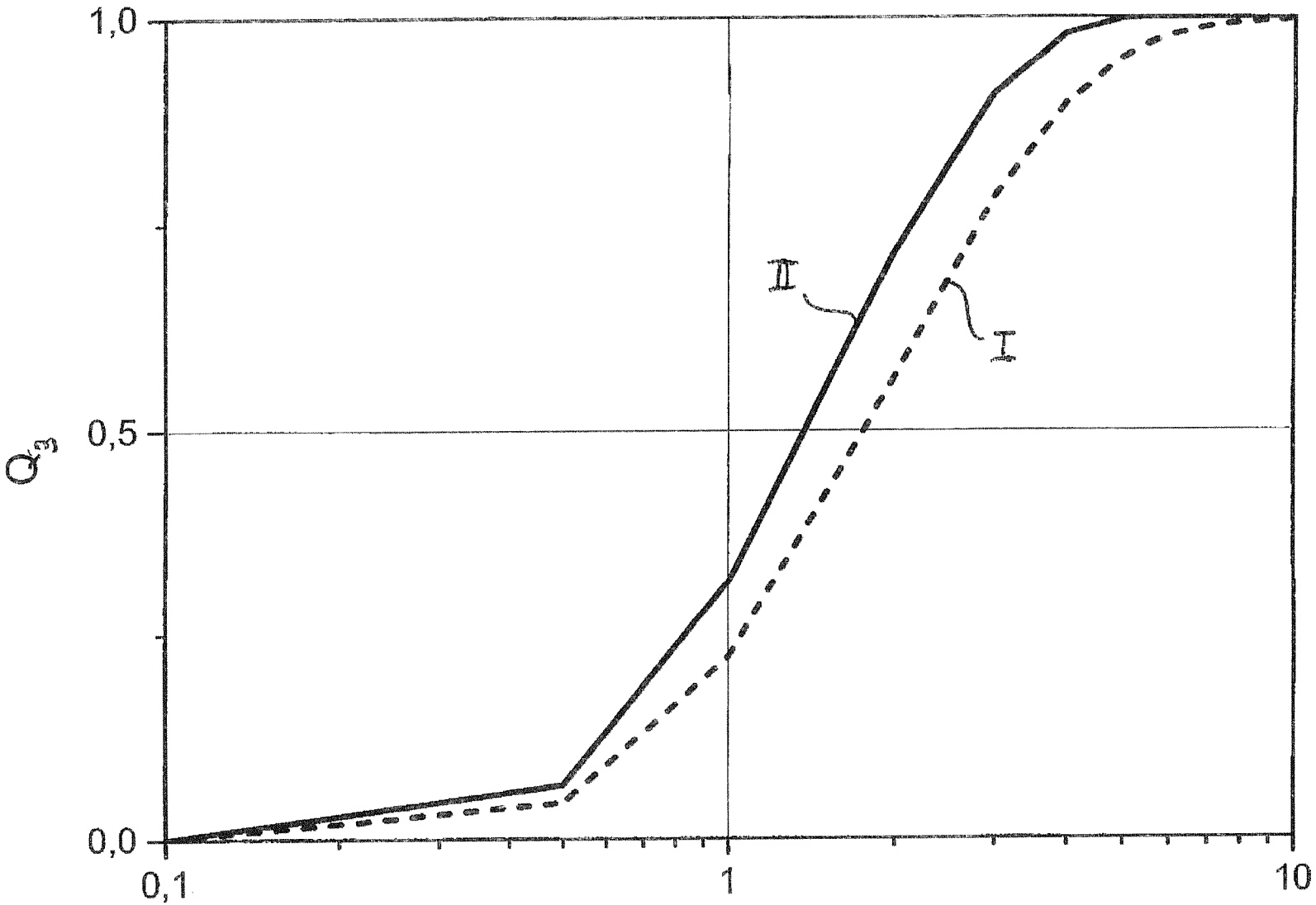

This powder was classified in a traditional separator without the feed cone according to the invention and without the dispersing plate according to the invention. The corresponding cumulative distribution curve I is shown in FIG. 14, where the cumulative distribution $Q_3$ (x) is plotted as a function of the grain size x, with $Q_3$ (x)=(mass of the particles≤particle size x)/(total mass of all particles) (see "Fine Grinding System with Impact Classifier Mill and Cyclone Classifier" by Giersemehl and Plihal, Power Handling and Processing Vol. 11, No. 3, July/September 1999). The separating efficiency κ is κ=0.51.

The same powder was classified in a separator according to the invention with the feed cone, dispersing plate with dispersing blades and an impact ring according to the invention, per FIG. 1 to 5, and an air guidance system per FIG. 6.

The cumulative distribution curve II obtained with the separator according to the invention is likewise shown in FIG. 14. The curve II differs from the curve I by an improved separating efficiency with κ=0.56 and a boosted yield of particles with particle sizes<3 μm. The yield for this particle range was 7.3% for the prior art (curve I) and 11.3% with the separator according to the invention (curve II). This is a higher yield by 54.8%.

It has been shown that the separator according to the invention results in a much better deagglomeration, as is manifested by the difference between the cumulative distribution curves I and II.

By using a separator according to the invention, which additionally has the air guidance system according to the invention per FIGS. 8 and 11, the separating efficiency κ for the same feeding material can be increased up to κ=0.7.

LIST OF REFERENCE NUMBERS

1 Separator
2 Housing
3 Upper housing portion
4 Separator cover
5 Lower housing portion
6 Fill pipe
7 Fill opening for feeding material
8*a,b* Separating air feed
9 Outlet opening, fine material
10 Outlet opening, coarse material
11 Suction fan
12 Drive mechanism
13 Drive shaft
14 Feeding material
15 Agglomerate
16 Deagglomerated particles
18 Separating space
20 Feed cone
22 Fastening element
24 Cone edge
26 Cone apex
30 Dispersing plate
31 Upper face
32 Bottom side
33 Edge
34 Edge surface
40 Dispersing vane
41 Inner surface
42 Outer surface
43 Top surface
44 Inner circumference
46 Dispersing surface
50 Impact ring
52 Inner surface of impact ring
54 Impact element
56 Impact surface
58 Conical wall
60 Separator wheel
62 Separator wheel paddle
70 Air guidance system
71 Annular wall
72 Guide vane ring
73 Guide vanes
74 Air window
75 Edge of air window
76 Guide plate
77*a,b* Guide plate
77*c* Guide plate end
78 Air slot
79 Ring
80 Cone ring
82 Particle guide element
84 First conical surface
86 Second conical surface
88 Inner edge
$B_P$ Width, impact element
$H_P$ Height, impact element
$H_S$ Height, dispersing vane
$L_S$ Length, dispersing vane
$\alpha$ Cone angle of cone ring
ß Aperture angle of feed cone
γ Angle of attack of guide plate
$D_L$ Inner diameter of air guidance system
$D_S$ Outer diameter of separator wheel
$L_{SA}$ Vertical swivel axis
$L_V$ Vertical axis
T Tangent
$R_L$ Inner radius of air guidance system
$R_1$ Radius of cone edge
$R_2$ Radius of dispersing plate
$R_3$ Radius of inner circumference of dispersing blade
$R_4$ Radius of curvature
$R_5$ Radius of curvature
$R_6$ Radius of curvature
$A_1$ Distance feed cone edge to top surface of dispersing vane
$A_2$ Distance inner surface of impact element to edge surface of dispersing plate
$A_3$ Distance end of guide plate to outer circumference of separator wheel
$A_4$ Distance inner circumference of air guide ring to outer circumference of separator wheel $P_1$ Rotation direction of separator wheel $P_2$ Flow direction of particle air stream

What is claimed is:

1. A deflector wheel separator, comprising:

a housing, a separator wheel situated in the housing, a feed cone, and a rotatable dispersing plate, on an upper face of which dispersing blades which are distributed across a periphery of the dispersing plate are arranged, wherein the feed cone is arranged on the housing at a distance from the dispersing plate, and wherein the dispersing plate is directly fastened to the separator wheel.

2. The separator as claimed in claim 1, wherein the feed cone has an aperture angle ß of $45° \leq ß \leq 90°$.

3. The separator as claimed in claim 2, wherein a distance $A_1$ between the cone edge of the feed cone and the dispersing blades of the dispersing plate is $0 < A_1 \leq 30$ mm.

4. The separator as claimed in claim 1, wherein the feed cone at its cone edge has a radius $R_1$ for which: $0.5 \times R_2 < R_1 < R_2$, where $R_2$ denotes the radius of the dispersing plate.

5. The separator as claimed in claim 4, wherein a radius $R_3$ of an inner circumference of the dispersing blades is $R_3 \leq R_1$.

6. The separator as claimed in claim 1, wherein each of the dispersing blades has a dispersing surface which is situated perpendicular to the rotation direction of the dispersing plate.

7. The separator as claimed in claim 1, wherein the dispersing blades are plates sticking up from the upper face of the dispersing plate and extending in the radial direction.

8. The separator as claimed in claim 1, wherein there is provided on the housing an impact ring, having impact elements distributed over the inner circumference and projecting in the direction of the dispersing plate.

9. The separator as claimed in claim 8, wherein a distance $A_2$ between the impact elements and the dispersing plate is $0 < A_2 \leq 30$ mm.

10. The separator as claimed in claim 8, wherein the impact elements are configured and arranged such that they lie opposite at least the dispersing blades.

11. The separator as claimed in claim 1, wherein the separator wheel has separator wheel paddles and an air guidance system having guide vanes for the supply of separating air, while an annular separating space is arranged between the separator wheel and the air guidance system.

12. The separator as claimed in claim 11, wherein the guide vanes are guide plates protruding into the separating space and extending in a vertical direction.

13. A separator, comprising:

a separator wheel having separator wheel paddles;

a feed cone arranged stationary on a housing of the separator and located above the separator wheel and below a fill pipe through which all feeding material is supplied to the separator and is able to slide down the feed cone; and an air guidance system having guide vanes and a separating air feed for the supply of separating air, while an annular separating space is arranged between the separator wheel and the air guidance system, wherein the guide vanes are guide plates protruding into the separating space and extending in a vertical direction.

14. The separator as claimed in claim 13, wherein a dispersing plate is fastened to the separator wheel.

15. The separator as claimed in claim 13, wherein the air guidance system has air windows and a guide plate is arranged on at least one edge of the air windows.

16. The separator as claimed in claim 15, wherein guide plates are arranged on opposite edges of the air windows.

17. The separator as claimed in claim 16, wherein the guide plates are arranged between two respective air windows such that their ends converge on each other.

18. The separator as claimed in claim 16, wherein the two respective guide plates which are arranged at each air window are oriented parallel to each other.

19. The separator as claimed in claim 15, wherein the guide plates are curved in the direction of the separator wheel.

20. The separator as claimed in claim 19, wherein the guide plates have a single radius of curvature $R_4$.

21. The separator as claimed in claim 20, wherein the radius of curvature $R_4$ is $5 \text{ mm} \leq R_4 \leq 2000$ mm.

22. The separator as claimed in claim 19, wherein the guide plates are curved such that a radius of curvature $R_4$ decreases in the direction of the separator wheel.

23. The separator as claimed in claim 13, wherein the guide plates make an angle of attack $\gamma$ with the radius $R_L$ of the air guidance system of $30° \leq \gamma \leq 60°$.

24. The separator as claimed in claim 13, wherein the air guidance system has at least one cone ring with a particle guide element protruding into the separating space and having a first conical surface.

25. The separator as claimed in claim 24, wherein the first conical surface is arranged n the upper face of the particle guide element and forms an angle $\alpha$ with a vertical axis $L_V$ of $10° < \alpha < 90°$.

26. The separator as claimed in claim 24, wherein a distance $A_3$ from the inner edge of the particle guide elements and/or ends of guide plates to an inner circumference of the separator wheel is:

$$0.005 \cdot A_4 \leq A_3 \leq 0.5 \cdot A_4.$$

27. The separator as claimed in claim 13, wherein a distance $A_4$ between an inner circumference of the air guidance system and an outer circumference of the separator wheel is $$A_4 = \tfrac{1}{2} \cdot D_S(V-1)$$

where $V = D_L/D_S$ with $1.01 \leq V \leq 1.2$and $D_S$ denotes an outer diameter of the separator wheel and $D_L$ an inner diameter of the air guidance system.

28. The separator as claimed in claim 27, wherein the ratio $V = D_L/D_S$ is $1.05 \leq V \leq 1.1$.

29. The separator as claimed in claim 13, wherein the air guidance system has at least one circumferential horizontal air slot.

* * * * *